United States Patent [19]

Lee

[11] 4,319,426

[45] Mar. 16, 1982

[54] TOY GRENADE WITH DELAY-TRIGGERING MECHANISM

[76] Inventor: Kwang H. Lee, 218 Kwang Ming Rd., Peitou District, Taipei, Taiwan

[21] Appl. No.: 120,299

[22] Filed: Feb. 11, 1980

[51] Int. Cl.[3] ..... A63H 5/00

[52] U.S. Cl. ..... 46/200; 46/176

[58] Field of Search ..... 46/196, 232, 1 R, 197, 46/198, 199, 200, 176

[56] References Cited

U.S. PATENT DOCUMENTS

| | | | |
|---|---|---|---|
| 358,487 | 3/1887 | Seiler | 46/200 |
| 2,897,630 | 8/1959 | Horowitz et al. | 46/196 |
| 3,019,554 | 2/1962 | Rago | 46/200 |
| 3,029,556 | 4/1962 | Ayala | 46/196 |
| 3,029,557 | 4/1962 | Lemelson | 46/196 |
| 3,139,697 | 7/1964 | Mier | 46/196 |
| 3,225,490 | 12/1965 | Ostrom | 46/200 |
| 3,878,639 | 4/1975 | Scheelar et al. | 46/1 R |

*Primary Examiner*—Robert Peshock
*Assistant Examiner*—Michael J. Foycik
*Attorney, Agent, or Firm*—Robert E. Burns; Emmanuel J. Lobato; Bruce L. Adams

[57] ABSTRACT

The present invention relates to one kind of toy grenade that can be triggered a few seconds after the safety pin ring has been pulled outward so that a strikingly similar effect of an actual grenade is obtained, and it includes few component parts which ensure both its low cost of production and its durability in consecutive use.

6 Claims, 3 Drawing Figures

TOY GRENADE WITH DELAY-TRIGGERING MECHANISM

BACKGROUND OF THE INVENTION

The toy grenades found on sale at present are exclusively of knock-triggered or impact triggered type, in other words, a flying grenade of such kind is immediately triggered at the very instant it just touches the ground without any time delay like that of real grenades. Moreover, such kind of grenades can be triggered only when they strike the ground in some definite manner, and this does not certainly ensure a successful triggering. Consequently, such toy grenades are liable to lack the impression of reality and fail to arouse the interest of people. Notwithstanding that the fast developing electronic industry has made it possible to accomplish an effect of delayed explosion easily with only a few tiny electronic parts, it constributes little to toy grenade technology. Moreover, because the manner that children play with toy grenades is exclusively by hurling it at their imaginary enemies which always results in a severe knock, impact, and jolt when a hurled toy grenade falls, bounces, and rolls on the hard ground, this excludes the possibility of the application of the delicate yet fragile electronic parts for they are extremely vulnerable to such frequent and terrible concussion which may cause serious disconnection, poor contact, or destruction of the complicated circuit.

Accordingly, it is an important object of the present invention to provide one kind of toy grenades with a delay triggering device the explosive head of which can be exploded automatically a few seconds after the safety pin ring has been pulled unless the safety lever is kept squeezed, thus simulating the characteristic of an actual grenade to an extent to entertain the players.

It is another object of the present invention to provide one kind of delay triggered toy grenades comprising a few knock-endurable component parts which not only enable the invention to tolerate severe knocks and concussion without being injured by incessant use, but also effectively reduce the cost of production so that everyone can afford it.

It is a further object of the present invention to provide one kind of delay triggered toy grenades having a consumed explosive head that can be recharged conveniently after having been used.

SUMMARY

The present invention relates to one kind of toy grenades and more particularly, to one of which the attached explosive can be automatically triggered a few seconds after the safety pin ring has been pulled outward, and is characterized in that the mechanism of delay triggering effect involves the application of the phenomenon that a compressed elastic cup clinging onto a flat, smooth surface can be slowly pulled apart when a pulling force is exerted on it. Since the whole toy grenade is composed of simply a few knock-resistant parts, it can efficiently remedy the defects of the conventional ones.

Numerous other features, objects, and advantages of the invention will become apparent from the following specification when read in connection with the accompanying drawing in which;

DETAILED DESCRIPTION OF PREFERRED EMBODIMENTS

Figure 1:
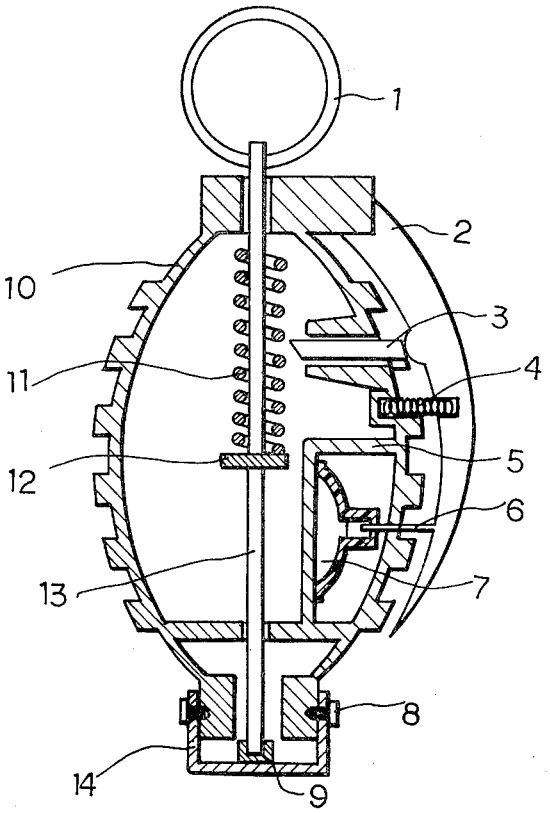
FIG. 1 is a longitudinal sectional view of the invention.

With reference now to the drawing, and more particularly FIG. 1 thereof, there is shown a longitudinal cross section of the present invention revealing all the component parts including the firing pin ring (1), safety lever (2), step member (3), lever spring (4), suction plate (5), connecting rod (6), elastic suction cup (7), pivot (8), explosive head (9), casing (10), striker spring (11), stop flange (12), firing pin (13) and breech (14).

Figure 2:
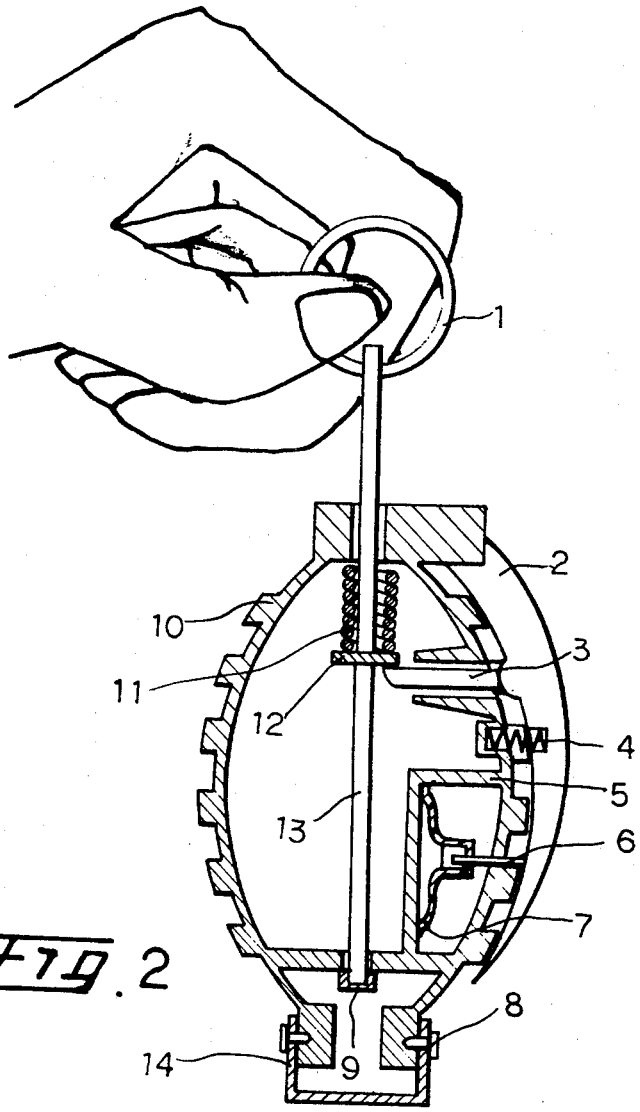
FIG. 2 illustrates the cocked state of the invention.

To play with this invention, please refer to FIG. 2 in connection with the description hereinafter. First, hold the body of the grenade in the right hand with the four fingers except the thumb resting on the safety lever. Then pull the safety pin ring (1) upward with another hand to a certain extent so that the position of stop flange (12) rises to just above stop member (3), and squeeze the safety lever (2) subsequently. Hitherto striker spring (11) is compressed, while stop member (3) is pressed inward of the casing and contacts with stop flange (12) so that firing pin (13) may not be pushed down by compressed striker spring (11). Simultaneously both the safety lever (4) and the connecting rod are also pressed inward, therefore most of the gas inside the elastic cup (7) is forced out so that the elastic cup holds to the suction plate (5).

When the cocked grenade is thrown and no longer hand held, the released force developed by the compressed lever spring starts to act on the safety lever to move it to its original position. However the action is damped by the adhesive force between elastic cup (7) and suction plate (5) hence delaying the displacement of the safety lever. When the elastic cup is ultimately pulled apart from the suction plate, the safety lever is completely released and the trigger no longer hampers the stop flange thus the firing pin is pushed inward to strike the attached explosive head against breech (14) to explode it. Through the delaying effect of the elastic cup, a time lag of a few seconds before triggering is obtained to enliven this toy. As the duration of the time lag depends on the physical factors of both the elastic cup and the lever spring, an optimal delay period can be acquired through suitable selection and design. Again, even if the firing pin ring has been pulled outward, the cocked grenade can remain untriggered provided the fingers do not release the safety lever thus further enhancing the similarity of the invention to actual grenades. In this regard, it educational value in terms of national defence is undeniable.

Figure 3:
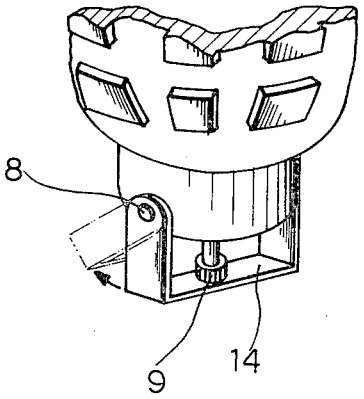
FIG. 3 illustrates the operating mode of the breech for loading an explosive head into the toy grenade according to the invention.

Besides, the consumed explosive head can be conveniently replaced by a new one for repeated use by turning the pivoted U-shaped breech aside as shown in FIG. 3.

All of the features of the invention mentioned above provide a successful toy that provides the user with a high sense of reality, interest and educational value. Furthermore, the simple structure not only makes it possible for the toy to endure frequent, terrible shock, but also greatly lowers its price thus permitting it be broadly accepted by consumers. In view of these facts, this invention is by far one of the most valuable toys.

It is evident that those skilled in this art may make numerous uses and modifications of and departures from the specific embodiments described herein without departing from the specific inventive concepts. Consequently, the invention is to be construed as embracing each and every novel feature and novel combination of features present in or possessed by the apparatus and techniques herein disclosed and limited solely by the spirit and scope of the appended claims.

What is claimed are:

1. A toy hand grenade, comprising:

a hollow casing;

a firing pin extending into said casing and having a firing pin ring at a first end thereof outside of said casing for grasping to pull said firing pin axially thereof outwardly of said casing, and said firing pin ring preventing said firing pin from traveling completely into said casing;

a flange on said firing pin intermediate said first end and a second end of said firing pin and within said casing;

a safety lever mounted externally on said casing and mounted for pivoting toward and away from said casing;

a movable stop member extending into said casing and positioned for being moved by said safety lever when said safety lever is pivoted toward said casing to travel toward and engage said firing pin flange and prevent said firing pin from traveling into said casing further than the position where said flange is engaged by said movable stop member, and said stop member movable to disengage said firing pin flange when said safety lever pivots away from said casing to allow said firing pin to travel further into said casing;

means for detonating an explosive head with said second end of said firing pin;

firing pin biasing means for biasing said firing pin toward said explosive head to strike and detonate said explosive head with said firing pin second end;

safety lever biasing means for biasing said safety lever to pivot away from said casing; and holding and releasing means for holding said safety lever at a position with said movable stop member extending sufficiently into said casing to engage said firing pin flange and hold said firing pin in a position partially inserted into said casing and for releasing said safety lever after a time interval to permit said safety lever to pivot away from said casing and release said movable member from said firing pin flange to free said firing pin to move inwardly of said casing under the influence of said firing pin biasing means and strike and detonate an explosive head.

2. A toy hand grenade according to claim 1, wherein said hollow casing has an open end portion opposite said firing pin second end, and wherein said means for detonating an explosive head is comprised of a movable breach mounted on said casing opposite said casing open end portion and movable to a position clear of said casing.

3. A toy hand grenade according to claim 1, wherein said movable breach is comprised of a yoke-like element having a pair of arms pivotally mounted on said casing to pivot between a position covering said casing open end portion and a position clear of said casing open end portion.

4. A toy hand grenade according to claim 1, wherein said holding and releasing means is comprised of an internal surface within said casing, a suction cup facing said internal casing surface for compressing against and adhering to said internal casing surface, and a connecting rod connecting said safety lever and said suction cup for compressing said suction cup when said safety lever is pivoted toward said casing to move said movable stop member to engage said firing pin flange and for holding said safety lever in a position with said firing pin flange engaged by said movable stop member until said suction cup loses suction and releases from said internal surface casing.

5. A toy hand grenade according to claim 1, wherein said firing pin biasing means is comprised of a coil compression spring disposed between said firing pin flange and said casing with said firing pin extending axially through said coil compression spring and positioned for being compressed when said firing pin is pulled outwardly of said casing.

6. A toy hand grenade according to claim 1, wherein said safety lever biasing means is comprised of a compression spring positioned between said safety lever and said casing for biasing said safety lever away from said casing.

* * * * *